US009103581B2

(12) United States Patent
Babinski et al.

(10) Patent No.: US 9,103,581 B2
(45) Date of Patent: Aug. 11, 2015

(54) CONTINUOUSLY ADJUSTABLE DOOR BINS

(71) Applicant: Electrolux Home Products, Inc., Charlotte, NC (US)

(72) Inventors: Tyler Babinski, Anderson, SC (US); Cory Dale Simpson, Abbeville, SC (US); Nilton Carlos Bertolini, Chonburi (TH)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 13/920,686

(22) Filed: Jun. 18, 2013

(65) Prior Publication Data

US 2014/0366569 A1 Dec. 18, 2014

(51) Int. Cl.

| | |
|---|---|
| ***F25D 25/02*** | (2006.01) |
| ***F25D 25/04*** | (2006.01) |
| ***F25D 23/04*** | (2006.01) |
| ***F25D 23/06*** | (2006.01) |

(Continued)

(52) U.S. Cl.

CPC ..... *F25D 25/024* (2013.01); *F25D 23/04* (2013.01); *A47B 57/06* (2013.01); *A47B 57/20* (2013.01); *F25D 23/067* (2013.01); *F25D 25/04* (2013.01)

(58) Field of Classification Search

CPC ..... F25D 23/02; F25D 23/025; F25D 23/028; F25D 23/04; F25D 23/123; F25D 25/00; F25D 25/024; F25D 25/025; F25D 2325/021; A47B 57/06; A47B 57/08; A47B 57/10; A47B 57/16; A47B 57/20; A47B 57/26

USPC ..... 312/405.1, 321.5, 351, 408, 405; 108/106–108; 211/192; 292/137, 138, 292/145, 163, 175, 169, 173, 140, 143, 292/DIG. 11

See application file for complete search history.

(56) References Cited

U.S. PATENT DOCUMENTS

| | | | | |
|---|---|---|---|---|
| 716,852 | A * | 12/1902 | Baker | 248/244 |
| 1,060,448 | A * | 4/1913 | Goeden | 292/177 |

(Continued)

FOREIGN PATENT DOCUMENTS

| | | | |
|---|---|---|---|
| CN | 1952564 | A | 4/2007 |
| DE | 19633978 | A1 | 2/1998 |

(Continued)

OTHER PUBLICATIONS

International Search Report and Written Opinion issued in Application No. PCT/US2014/039318 dated Oct. 13, 2014.

*Primary Examiner* — Daniel J Troy
*Assistant Examiner* — Andrew Roersma
(74) *Attorney, Agent, or Firm* — Pearne & Gordon LLP

(57) ABSTRACT

Provided is a storage system and a refrigeration appliance including the storage system for storing food items in a temperature-controlled environment. The storage system includes a bin and a tab attached to the bin. The tab is configured to couple the bin to a track and guide the bin along a continuum of positions on the track. The storage system further includes an actuator attached to the bin that is selectively movable between a first position and a second position. The storage system still further includes a pin slidingly engaged with the bin. The bin is movable into a plurality of positions relative to the track. The pin in an engaged position is configured to prevent movement of the bin at any desired point within the continuum of positions on the track.

20 Claims, 9 Drawing Sheets

(51) Int. Cl.

| | |
|---|---|
| ***A47B 57/06*** | (2006.01) |
| ***A47B 57/20*** | (2006.01) |
| ***A47B 96/04*** | (2006.01) |

(56) References Cited

U.S. PATENT DOCUMENTS

| | | | | | |
|---|---|---|---|---|---|
| 2,136,854 | A | * | 11/1938 | Knott | 292/169.11 |
| 2,741,370 | A | * | 4/1956 | Dills | 108/146 |
| 3,885,846 | A | * | 5/1975 | Chuang et al. | 312/306 |
| 3,982,801 | A | * | 9/1976 | Heidorn et al. | 312/306 |
| 4,056,196 | A | * | 11/1977 | Brauning | 211/207 |
| 4,171,789 | A | * | 10/1979 | Vander Hoek et al. | 248/243 |
| 4,859,010 | A | | 8/1989 | Jeziorowski | |
| 5,375,924 | A | | 12/1994 | Pohl | |
| 6,085,542 | A | * | 7/2000 | Johnson et al. | 62/441 |
| 6,582,038 | B2 | | 6/2003 | Olguin | |
| 7,748,805 | B2 | | 7/2010 | Lucas | |
| 8,052,236 | B2 | * | 11/2011 | Kim | 312/405.1 |
| 2010/0133970 | A1 | * | 6/2010 | Shin et al. | 312/408 |
| 2013/0081421 | A1 | | 4/2013 | Kwon et al. | |

FOREIGN PATENT DOCUMENTS

| | | | | | |
|---|---|---|---|---|---|
| DE | 102008014885 | A1 | * | 9/2009 | F25D 23/04 |
| EP | 1804012 | A1 | * | 7/2007 | F25D 23/02 |
| GB | 2176885 | A | | 1/1987 | |
| KR | 100392393 | B1 | * | 7/2003 | F25D 23/04 |
| KR | 100775822 | B1 | * | 11/2007 | F25D 25/02 |
| KR | 20080064108 | A | | 7/2008 | |
| WO | 2009071341 | A1 | | 6/2009 | |

* cited by examiner

CONTINUOUSLY ADJUSTABLE DOOR BINS

BACKGROUND OF THE INVENTION

1. Field of the Invention

This application relates generally to a storage system for a refrigeration appliance, and more specifically to a bin that is continually adjustable to a plurality of different vertical positions relative to the refrigeration appliance door without fully disconnecting the bin from the refrigeration appliance door.

2. Description of Related Art

One configuration of a conventional refrigeration appliance includes a fresh food compartment and a freezer compartment. At least one door can provide access to both the fresh food compartment and the freezer compartment, allowing access to the stored items from outside the refrigeration appliance. Conventional refrigeration appliances typically include shelves or bins mounted to the interior of the door for storing fresh and frozen food items within the fresh food and the freezer compartments. Such a configuration is convenient, as door-mounted bins increase the amount of storage space that is easily accessed by the user, rather than having to reach into the interior areas of the refrigerator. Door-mounted bins can also provide the convenience of configurations beneficial to store items such as bottles, cans, and/or other food or beverage containers.

However, the convenience of door-mounted bins is often lessened due to a number of factors including the typically limited number of discreet mounting locations for the bins that can limit the variety of storage configurations. Additionally, the design of many bins necessitates the use of two hands to move the bins to a desired location. Such conventional bin mounting arrangements require a user to move the bin with two hands while fully disconnecting the bin from the refrigeration appliance door. Users can grasp the bin on each side and remove the bin from mounting lugs and move the bin to a desired location and then re-attach the bin to another set of mounting lugs. Accordingly, improvements to refrigeration appliance storage bins and their mounting structures are desired.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

According to one aspect, the subject application involves a storage system for storing food items in a temperature-controlled environment. The storage system includes a bin and a tab attached to the bin. The tab is configured to couple the bin to a track and guide the bin along a continuum of positions on the track. The storage system further includes an actuator attached to the bin that is selectively movable between a first position and a second position. The storage system still further includes a pin slidingly engaged with the bin. The bin is movable into a plurality of positions relative to the track. The pin in an engaged position is configured to prevent movement of the bin at any desired point within the continuum of positions on the track.

According to another aspect, the subject application involves a refrigeration appliance including a compartment within the refrigeration appliance for storing food items in a refrigerated environment. The refrigeration appliance also includes a refrigeration system for providing a cooling effect to the compartment. The refrigeration appliance further includes a door attached to the refrigeration appliance, the door including a storage system and a track. The storage system includes a bin and a tab attached to the bin. The tab is configured to couple the bin to a track and guide the bin along a continuum of positions on the track. The storage system further includes an actuator attached to the bin that is selectively movable between a first position and a second position. The storage system still further includes a pin slidingly engaged with the bin. The bin is movable into a plurality of positions relative to the track. The pin in an engaged position is configured to prevent movement of the bin at any desired point within the continuum of positions on the track.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

DETAILED DESCRIPTION

Figure 1:
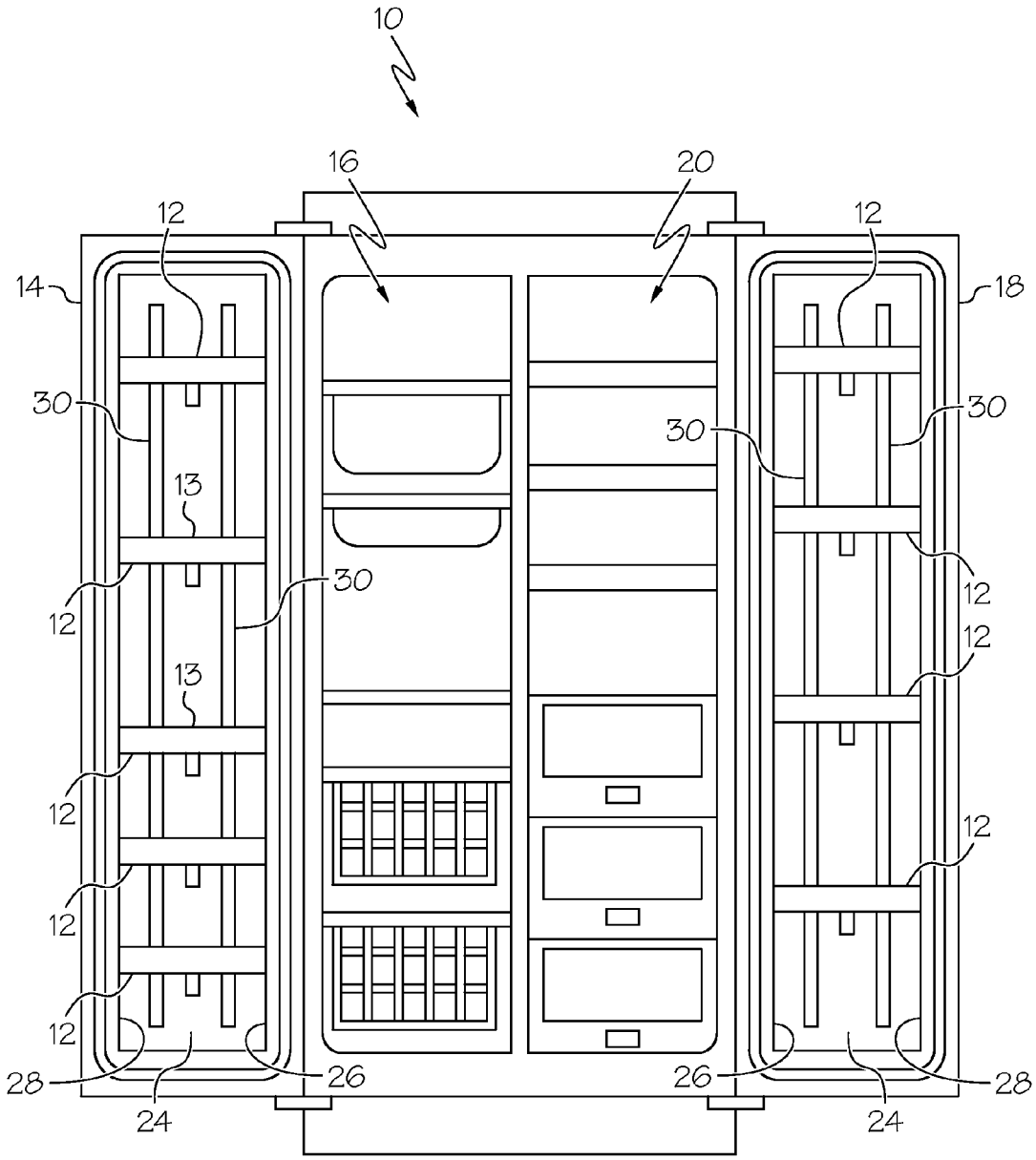
FIG. 1 is a schematic view of a refrigerator including a schematic depiction of example storage systems in accordance with aspects of the present invention.

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the present disclosure. Still further, in the drawings, the same reference numerals are employed for designating the same elements.

For the purposes of this disclosure, the term bin is used generically to describe any number of bins, shelves, or other similar structures used to support items. In one example, the bin can include a substantially flat surface with walls extending upward from the flat surface. Other examples can include wire-frame constructions, shelves designed to hold cans, shelves designed to hold dairy products, etc.

FIG. 1 depicts a schematic view of a refrigeration appliance such as refrigerator 10 including a schematic depiction of example storage systems 12 in accordance with aspects of the present invention. It is to be appreciated that the view of FIG. 1 omits some detail of the storage systems 12 for simplicity. The refrigerator 10 can include a first door 14 which provides access to a freezer compartment 16. The freezer compartment 16 is configured for storing food items in a freezing environment having a target temperature below zero degrees Centigrade. A second door 18 can provide access to a fresh food compartment such as refrigerator compartment 20. The refrigerator compartment 20 is configured for storing food items in a refrigerated environment having a target temperature above zero degrees Centigrade. Each of the doors 14, 18 can include a plurality of interior walls, such as a rear wall 24, a right wall 26, and a left wall 28. In one example, the rear wall 24, the right wall 26, and the left wall 28 can all be portions of one unitary door liner component. While not shown, the refrigerator 10 includes a refrigeration system for providing a cooling effect to the refrigerator compartment 20 and the freezer compartment 16.

The storage system 12 is configured to be mounted on one of the doors 14, 18 within a storage compartment, such as the freezer compartment 16 or the refrigerator compartment 20. The storage system 12 is configured to enable selective sliding of the storage system 12 along a continuum of locations on a track 30 mounted on a door such as the first door 14 or the second door 18. The storage system 12 is movable into a plurality of positions relative to the interior walls of the door. A number of storage systems 12 are shown at various elevations along the first door 14 and the second door 18. Either door 14, 18 can be provided with at least one storage system 12 of the subject invention. The storage system includes a bin 13. In one example, the bin 13 can be mounted to at least one track 30 attached to an interior wall such as the rear wall 24 of the first door 14. The bin 13 in this example extends across substantially the entire available width between the right wall 26 and the left wall 28, though it is appreciated that the width of the bin 13 can be varied in any of the example bins 13. The bin 13 can also include structure to store objects from its underside including, but not limited to hooks, racks, etc.

Figure 2:
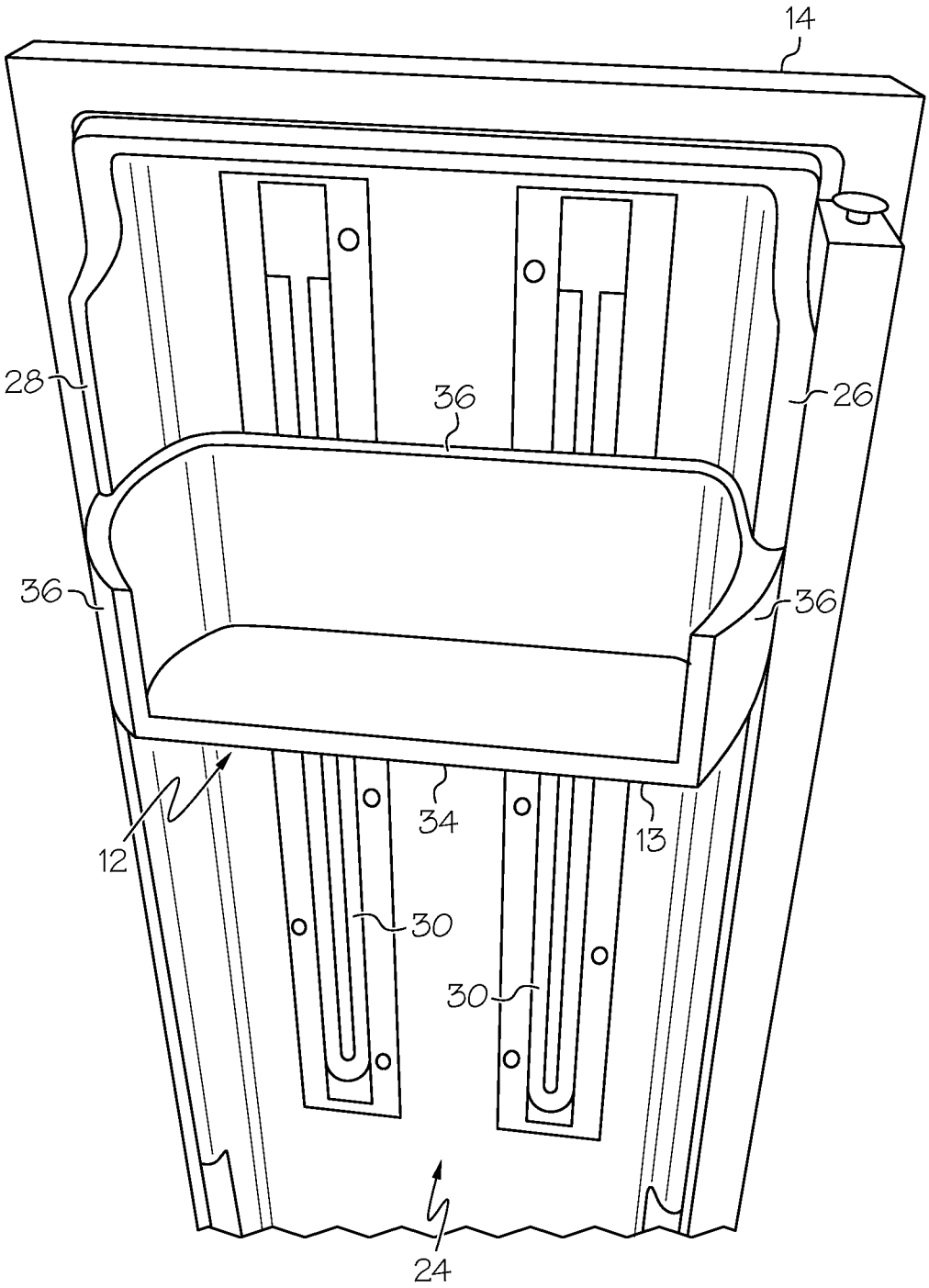
FIG. 2 is a schematic view of an example bin mounted to a door of the refrigerator in FIG. 1.

In FIG. 2, a perspective view of an interior portion of a door 14, 18 in a first example of the subject invention is shown. The view shows a bin 13 for storing food items in a temperature-controlled environment, such as the refrigerator 10. The bin 13 can include a substantially-horizontal platform 34 used as a support surface for supporting various objects, such as items that will be stored in the refrigerator 10. The platform 34 can be made of plastic, glass, wire, or any other suitable rigid material. For example, the platform 34 is shown as a substantially continuous flat support surface. The platform 34 can be coupled to a plurality of upwardly-extending walls 36 to form an open container configured to receive various objects such as food items.

The plurality of walls 36 can upwardly extend from the perimeter of the platform 34 to form a partially enclosed volume. In one example, four walls 36 can extend from the platform 34, and the walls can include various curves, undulations, etc. to correspond to any number of perimeter shapes of the platform 34. In another example, the wall 36 facing a user on the exterior of the refrigerator can be shorter than the remaining walls in order to improve access to the space within the bin 13 and limit necessary lifting required to insert and/or remove objects to and from the bin 13. In a more particular example, the bin 13 may not have a wall facing the user. It is to be appreciated that the walls 36 can be made of essentially the same material as the platform 34, for example, plastic, glass, wire, or any other suitable rigid material. In one example, the walls 36 can be molded together with the platform 34 such that the platform 34 and the walls 36 are constructed of one unitary piece.

Figure 3:
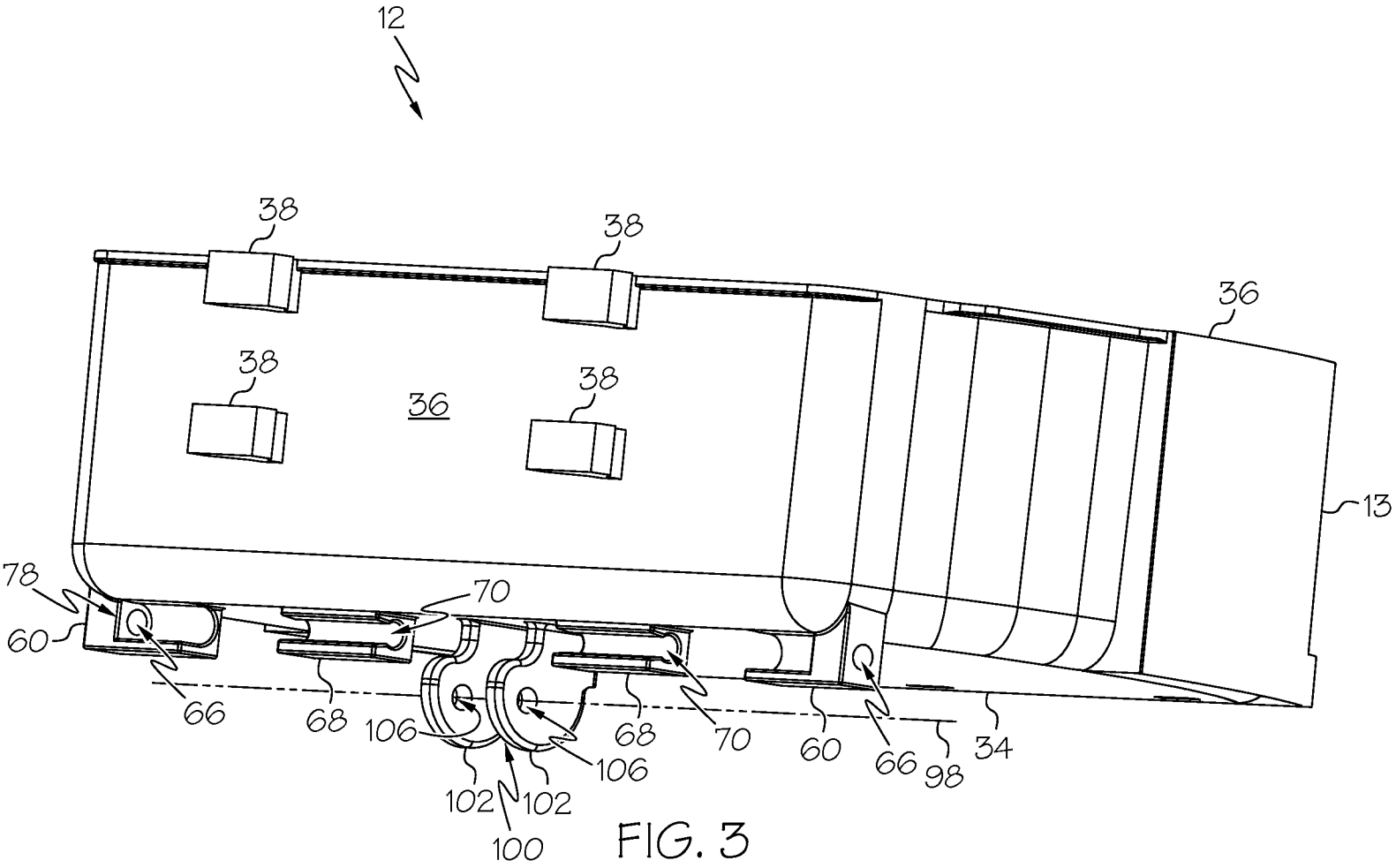
FIG. 3 is a perspective view of the bin from a lower, rear side of the bin of FIG. 2.

Turning to FIG. 3, a perspective view of the bin 13 from the lower, rear portion of the bin 13 is shown. The bin 13 includes a tab 38 attached to the bin 13. In one example, the tab 38 can be attached to the wall 36 that is typically adjacent the rear wall 24 of a door 14, 18. It is to be appreciated that the tab 38 can be made of essentially the same material as the platform 34 and the walls 36, for example, plastic, glass, wire, or any other suitable rigid material. In one example, the tab 38 can be molded together with the platform 34 and the walls 36 such that all of the components are constructed of one unitary piece. The bin 13 can include a plurality of tabs 38, such as the four tabs 38 shown in FIG. 3. As shown, the tab arrangement is in two columns and two rows, but any other number of tab arrangements are contemplated. In the shown example, the two by two arrangement of tabs 38 interacts with two tracks 30 (best seen in FIG. 2), two tabs 38 being located in each track 30.

Figure 4:
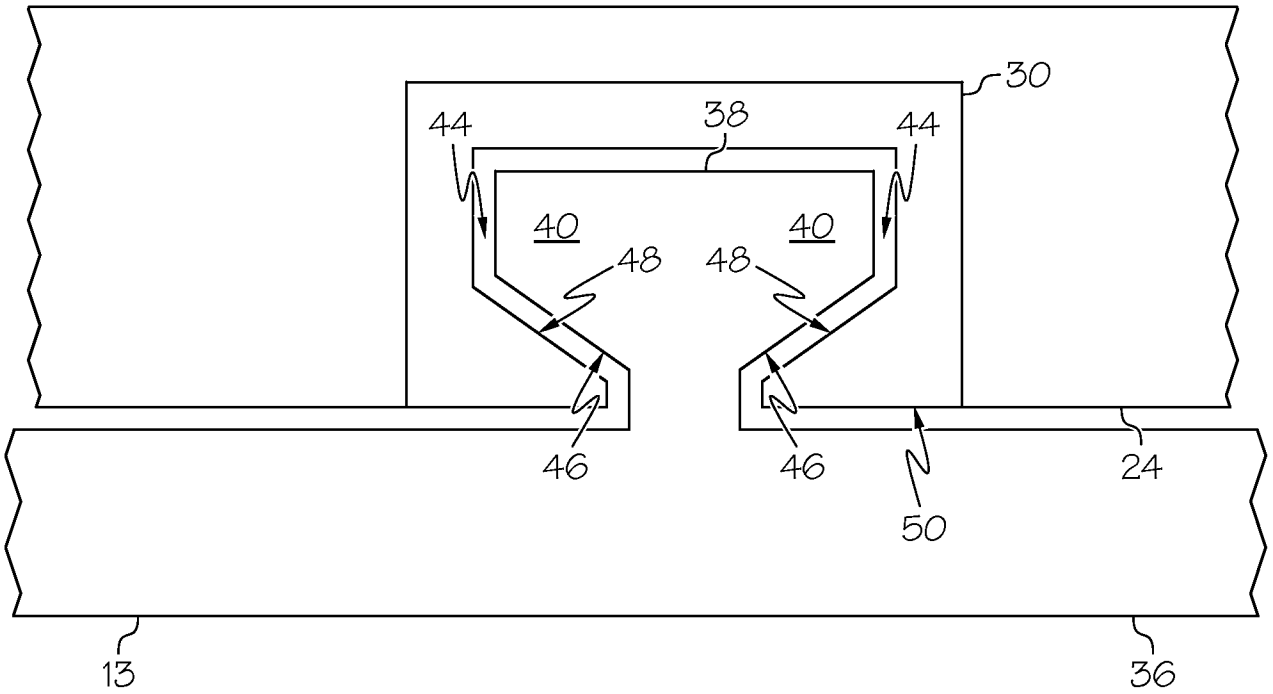
FIG. 4 is a cross-section view of an example tab interacting with an example track mounted to the door of FIG. 2.

The tab 38 itself can be formed into any number of shapes. In the shown example, the tab 38 includes a cross-section approximating a "T" when viewed from the top or the bottom of the tab 38. Regardless of the shape formation of the tab 38, the shape of the tab 38 is configured to interact with a corresponding shape of the track 30 mounted to an interior wall of one of the doors 14, 18. The interaction between the corresponding shapes of the tab 38 and the track 30 are configured to couple the bin 13 to the track 30. FIG. 4 illustrates one example tab 38 interacting with one example track 30. In the shown example, the arms 40 of the tab 38 extend into apertures 44 of the track 30. Location of the arms 40 within the apertures 44 enables a face 46 located on the arm 40 to interact with an interior surface 48 of the track 30. Interaction between the tab 38 and the track 30 help maintain a firm connection between the bin 13 and the door 14, 18. This interaction prevents the tab 38 and the bin 13 from separating from the door 14, 18, particularly when the weight of various objects acts upon the platform 34 of the bin 13. The moment arm caused by the weight of various objects upon the platform 34 and the bin 13 tends to move the bin 13 away from the track 30, however, the physical interference between the face 46 and the interior surface 48 prevents the bin 13 from separating from the track 30.

As can be appreciated, regardless of the shape formation of the tab 38 and the track 30, the manufacturing tolerances of the tab 38 and the track 30 can provide a relatively snug fit between the tab 38 and the track 30 while still allowing relative motion between the tab 38 and the track 30. The relative motion between the tab 38 and the track 30 enable the track 30 to guide the tab 38 and the attached bin 13 along a continuum of positions on the track 30. Furthermore, the manufacturing tolerances of the tab 38 and the track 30 can promote relatively smooth travel of the tab 38 within the track 30. Additionally, the interaction between the tab 38 and the track 30 can help maintain a desired alignment of the bin 13. In one example, the tab 38 and the track 30 can interact to place the platform 34 of the bin 13 in a substantially horizontal position such that various objects located on the platform 34 are more likely to remain in a desired location rather than sliding on the platform 34 or sliding off the platform 34. It is to be appreciated that a plurality of tabs 38 interacting with one or more tracks 30 can increase the stability of the bin 13. In the shown example, the path of travel of the bin 13 along the track 30 is vertical, such that the bin 13 travels along a continuum of positions up and down the door 14, 18.

As shown in FIG. 2, the track 30 can be attached to an interior wall such as the rear wall 24 of the first door 14. In other examples, the track 30 can be attached to another wall included in one of the doors 14, 18, or even wall in the freezer compartment 16 or the refrigerator compartment 20. Additionally or alternatively, the track can be integrally molded into the liner components forming the interior of the doors 14, 18 or the compartments 16, 20. As best seen in FIG. 4, the track 30 can be mounted to a particular depth within the rear wall 24 such that the outward facing surface 50 of the track 30 is substantially flush with the rear wall 24. In this way, the structure of the track 30 does not affect the usable storage space within the door 14, 18 or within a compartment 16, 20. Furthermore, as best seen in FIG. 2, the track 30 can be mounted such that the track 30 terminates below the top of the door 14, 18. With this arrangement, the tabs 38 of the bin 13 can be inserted into the track 30 and removed from the track 30 by moving the bin 13 to a particular height (i.e., the top of the track 30) and engaging or disengaging the tabs 38 with the track 30 by sliding the tabs 38 into the interior volume within the track 30. As illustrated in FIG. 1, the refrigerator 10 can include a number of bins 13 and a number of bins 13 at different elevations interacting with one or more tracks 30.

Figure 5:
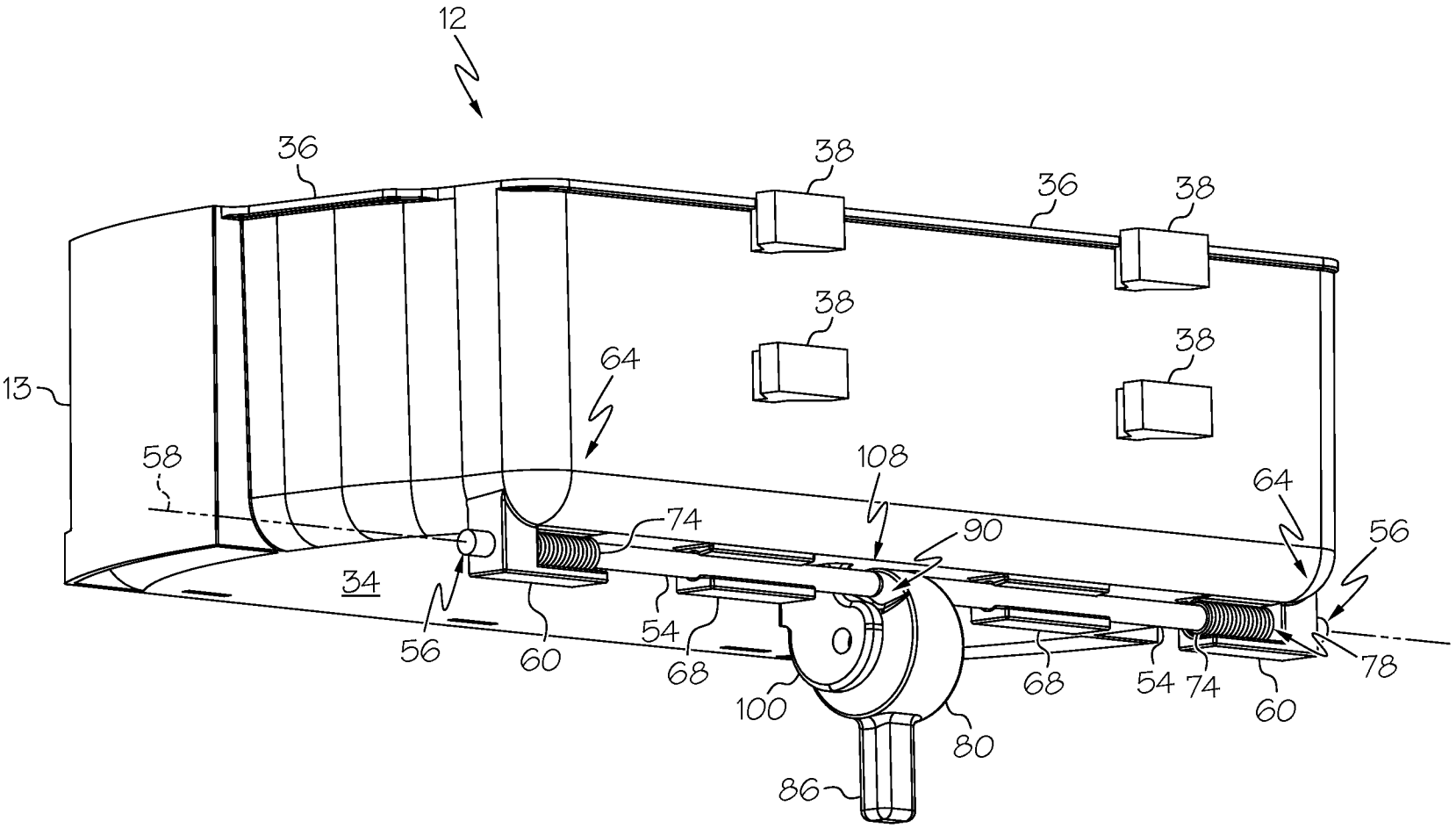
FIG. 5 is a perspective view of the bin with a locking mechanism including an actuator and a pin, the actuator is in a first position and the pin is in an engaged position.

Turning to FIG. 5, as the bin 13 can be moved up and down on the door 14, 18 through a continuum of positions, it can be advantageous to have included a locking mechanism to selectively prevent movement of the bin 13. A mechanism can be included on the bin 13 to prevent movement of the bin 13 after the bin 13 has been located in a desired location (e.g., a particular height). One example of a locking mechanism will now be described. The bin 13 includes a pin 54 slidingly engaged with the bin 13, and the pin 54 can be substantially cylindrical. A first end 56 of the pin 54 can be configured to contact a portion of the interior structure of the refrigerator. As shown in FIG. 1, the bin 13 is mounted to the tracks 30 within the doors 14, 18, and the first end 56 of the pin 54 can be configured to contact a portion of the right wall 26 or the left wall 28. In a more particular example, the bin 13 can include two pins 54.

Returning to FIG. 5, the pin 54 can be configured to travel relative to the bin 13 in a direction parallel with the main axis 58 of the bin 13. For simplicity, this direction parallel with the main axis 58 of the bin 13 will be referred to as a lateral direction. The pin 54 is slidingly engaged with the bin 13 and can be mounted to the bin 13 in any number of ways. In the shown example, the bin 13 includes a tab 60 at the lower rear corners 64 of the bin 13. Each tab 60 includes an aperture 66 (best seen in FIG. 3), through which the first end 56 of the pin 54 can be inserted. The diameter of the aperture 66 can be slightly larger than the diameter of the pin 54, enabling sliding engagement of the pin 54 with the tab 60. The bin 13 can further include bearings 68 located substantially centrally at the bottom rear portion of the bin 13. The bearings 68 can be constructed in any number of forms. In the shown example, the bearings 68 can be generally rectangular prisms including a cylindrical aperture 70 (best seen in FIG. 3) configured to permit the pin 54 to pass through the bearing 68 and be in sliding engagement with the bearing 68. The perimeter of the bearing 68 can be incomplete such that the cylindrical aperture 70 is open to the exterior along a portion of its diameter. As such, the pin 54 can be inserted into the cylindrical aperture 70 in a direction transverse to the main axis 58. In one example, the bearing 68 can be constructed such that the pin 54 can snap into place within the cylindrical aperture 70 as the pin 54 is inserted into the bearing 68. As with other components attached to the bin 13, the tabs 60 and the bearings 68 can be molded together with the bin 13 such that the platform 34 and the walls 36 are constructed of one unitary piece.

The pin 54 can be selectively placed in a release position and an engaged position. The pin 54 is configured to interact with a structure not attached to the bin 13 when the pin 54 is in a position termed an "engaged position." For example, each pin 54 can slide such that the first end 56 of the pin 54 comes into contact with a portion of the interior of the refrigerator 10 in order to selectively lock the bin 13 at a desired height. In one example, the first end 56 of the pin 54 can contact one or the other of the right wall 26 or the left wall 28. Other examples can include the first end 56 of the pin 54 contacting other interior surfaces of the refrigerator such as the rear wall 24 or other walls within one of the compartments 16, 20. The first end 56 can interact with the wall 26, 28 to create a force between the bin 13 and the wall 26, 28 suitable to prevent vertical movement of the bin 13. Simply put, the pin 54 creates a force in the lateral direction in such a magnitude as to overcome the force of gravity acting upon the bin 13 and stored objects held by the bin 13. As the force of gravity is overcome, the pin 54 holds the bin 13 in the desired elevation on the door 14, 18 while the bin 13 supports items to be stored in the refrigerator. The first end 56 of the pin 54 interacts with a portion of the interior of the refrigerator 10 in order to selectively lock the bin 13 at a desired height. It is to be appreciated that the pin 54 can interact with the door 14, 18 at any location along a continuum of locations, and is not limited by discrete locations such as individual bin or shelf mounts located on the door.

In the shown example pin 54 of FIG. 5, the first end 56 of the pin 54 can include a substantially flat end. In other examples, such as the example pin 54 of FIG. 6, the first end 56 can be pointed, rounded, or of any other shape. Additionally or alternatively to the first end 56 interacting with the wall 26, 28, the first end 56 can interact with a rail or an added pathway (not shown) that is attached to the wall 26, 28. The rail or added pathway can be designated as a replacement item, and can absorb anticipated physical wear that may result from interaction with the first end 56. In one particular example, the pointed end of the first end 56 can elastically deform the wall 26, 28 or the rail. In another example, the pointed end of the first end 56 can penetrate the wall 26, 28 or the rail. In still further examples, the first end 56 of the pin 54 can further include a relatively resilient material such as a rubber compound. The relatively resilient material can increase the frictional force between the pin 54 and the wall 26, 28 so that the bin 13 can be held at a particular elevation with greater weight supported within the bin 13.

Figure 6:
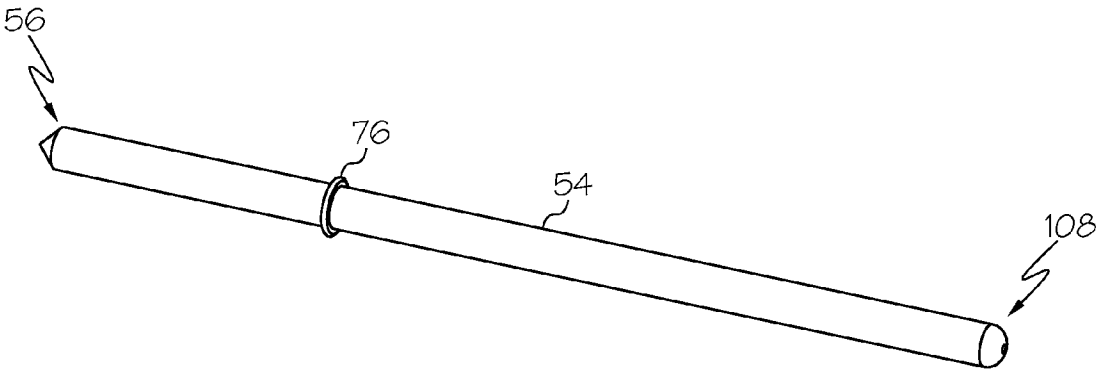
FIG. 6 is a perspective view of an example pin of FIG. 5.

The pin 54 can be biased toward a release position which can be defined as position of the pin 54 such that the first end 56 does not interact with a portion of the interior of the refrigerator 10. The release position enables the bin 13 to be moved along the track 30. In one example, the release position includes the pin 54 in a retracted position such that the first end 56 is drawn away from the wall 26, 28 toward the walls 36. The bin 13 can further include a biasing member such as spring 74 that biases the pin 54 toward the release position. As shown in FIG. 6, the pin 54 can include a ridge 76 located at the outside diameter of the pin 54. Returning to FIG. 5, the spring 74 can be a coil spring located around the pin 54 between the ridge 76 and a surface 78 of the tab 60. The length of the spring 74 can be selected such that the spring 74 is normally in compression, thus biasing the pin 54 toward the release position as the spring 74 urges the ridge 76 away from the surface 78.

Figure 7:
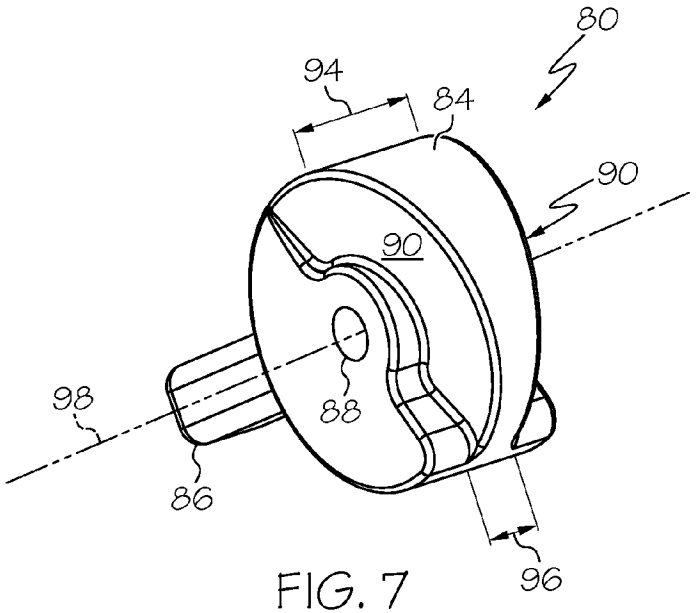
FIG. 7 is an example actuator of FIG. 5.

As previously described, the pin 54 can be selectively placed in the release position and the engaged position. The bin 13 can include an actuator 80 that is attached to the bin 13. In one example, as shown in FIG. 7, the actuator 80 can include a substantially cylindrical central portion 84 and a handle 86 extending from the central portion 84. The central portion can define an aperture 88 that can be used to mount the actuator 80 to the bin 13 as will be further described below. An area of the central portion 84 can include a variable width. In one example, the central portion 84 includes at least one surface 90 including a slope such that the central portion 84 has a first width 94, decreasing to a second width 96 as measured along an axis 98. In one particular example, two sides of the central portion 84 can include a sloping surface such as surface 90. The shown example includes a planar surface 90, however, other surface profiles are contemplated, such as a curvilinear surface, a surface with depressions that can act as detents, and any number of other surfaces.

Returning to FIG. 5, any suitable form of attachment of the actuator 80 to the bin 13 can be used, and in one example, the actuator 80 is rotatably mounted to the bin 13 with a clevis 100. The clevis 100 can be an integral part of the bin 13, or it can be attached as a separate component. As is best seen in FIG. 3, the clevis 100 can include two arms 102 that each define an aperture 106. The actuator 80 can be mounted to the clevis with a pin-like device (not shown), such that the actuator can rotate about the axis 98 when it is mounted to the clevis 100. Returning to FIG. 5, when the actuator 80 is mounted to the clevis 100, the spring 74 biases the pin 54 toward the release position, thereby placing the second end 108 of the pin 54 into contact with surface 90. The actuator 80 is mounted to the clevis 100 in a first position such that surface 90 is in contact with the pin 54 at the first width 94. The surface 90 at the first width 94 urges the pin 54 to the engaged position as shown. The interaction between the surface 90 and the pin 54 provides a force to overcome the force of the spring 74 to place the first end 56 of the pin 54 into contact with a portion of the interior of the refrigerator 10 in order to selectively lock the bin 13 at a desired height.

It is to be understood that the actuator 80 can include any number of other suitable, alternative constructions other than the rotating arrangement described above. For example, the actuator 80 can include a sliding mechanism. The sliding mechanism can be slid front-to-back, side-to-side, etc. relative to the bin 13. The actuator can also include a mechanism operated by moving two separate components together or apart, such as a pinching motion. Other actuator 80 designs can include rotating arrangements which rotate about axes that are perpendicular to the rotational axis of the actuator 80 as shown in FIG. 5. Regardless of the particular mechanism chat is used for the actuator 80, it is movable between at least two positions as will be described below.

Figure 8:
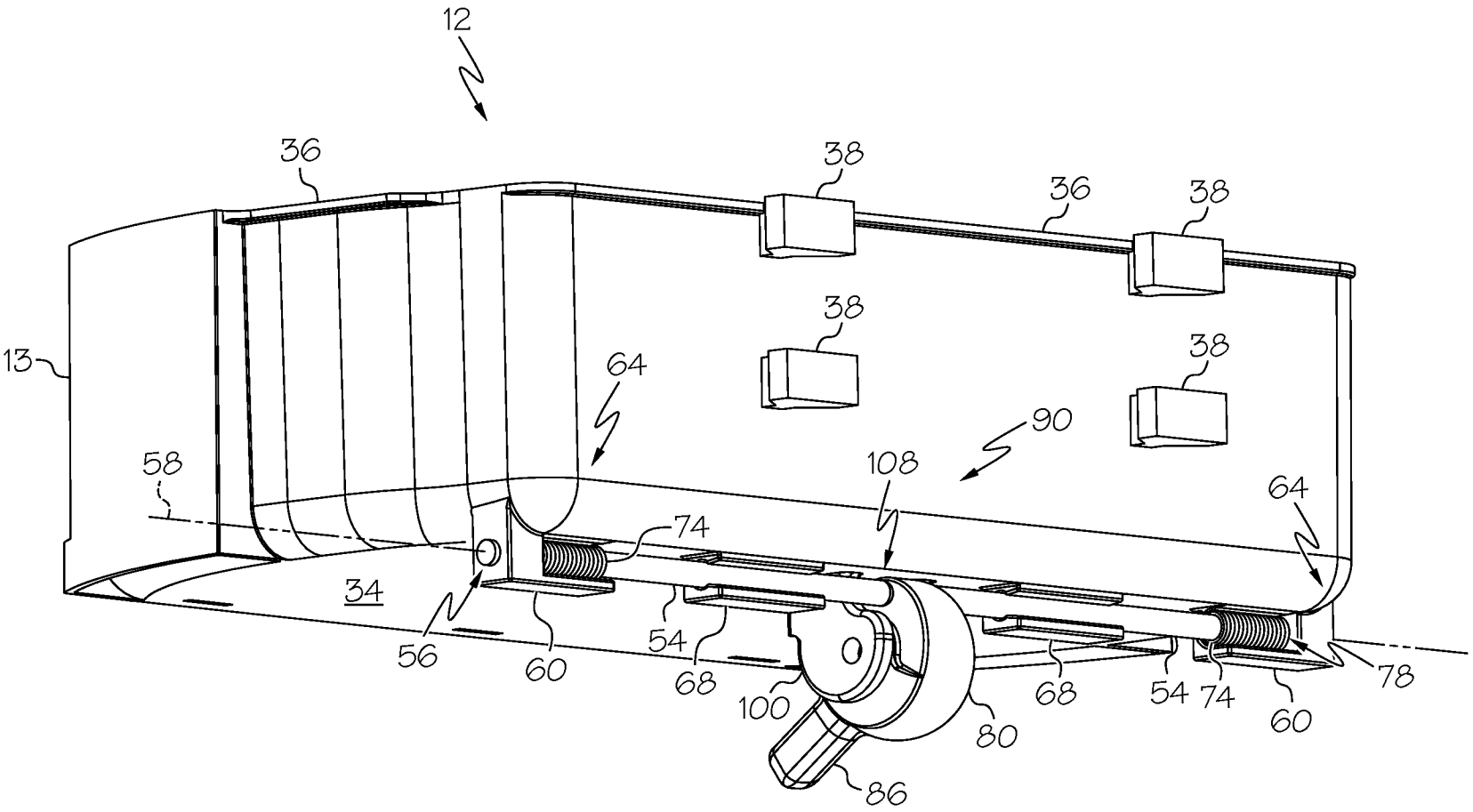
FIG. 8 is similar to FIG. 5, where the actuator is in a second position, and the pin is in a release position.

The actuator 80 can be selectively movable between a first position as shown in FIG. 5 (corresponding to the engaged position), and a second position as shown in FIG. 8. While in the second position, the actuator 80 has been rotated such that the second end 108 of the pin 54 contacts the surface 90 at the second width 96. In one example, such as the one shown, the user can simply grasp the handle 86 and apply a force to rotate the handle 86 about axis 98 thereby rotating the actuator 80. As the second width 96 creates a longer distance between the surface 90 and the tab 60, the longer distance enables the force of the spring 74 to urge the pin 54 away from the walls 26, 28 and into the release position. When the pin 54 is in the release position, the bin 13 is movable into a plurality of positions relative to the track 30. As such, a user can move the bin 13 to a selected location along a continuum of locations included on the track 30. After the bin 13 is positioned at a desired location, the user can move the actuator 80 back to its first position to urge the pin 54 to return to the engaged position in order to prevent movement of the bin 13 at any desired point within the continuum of positions on the track 30. In another example, the actuator 80 can include a device that would urge the actuator 80 to return to the first position rather than rely upon interaction with the user. For example, after the user locates the bin 13 at a desired elevation along the track, 30, the user can simply remove the force applied to the actuator 80, and the actuator 80 will return to its first position, thereby urging the pin 54 into the engaged position and locking the bin 13 at a particular location along the track 30. Such a device can include structure similar to a clock spring, or any other device that would urge the actuator 80 to rotate back to its first position.

Figure 9:
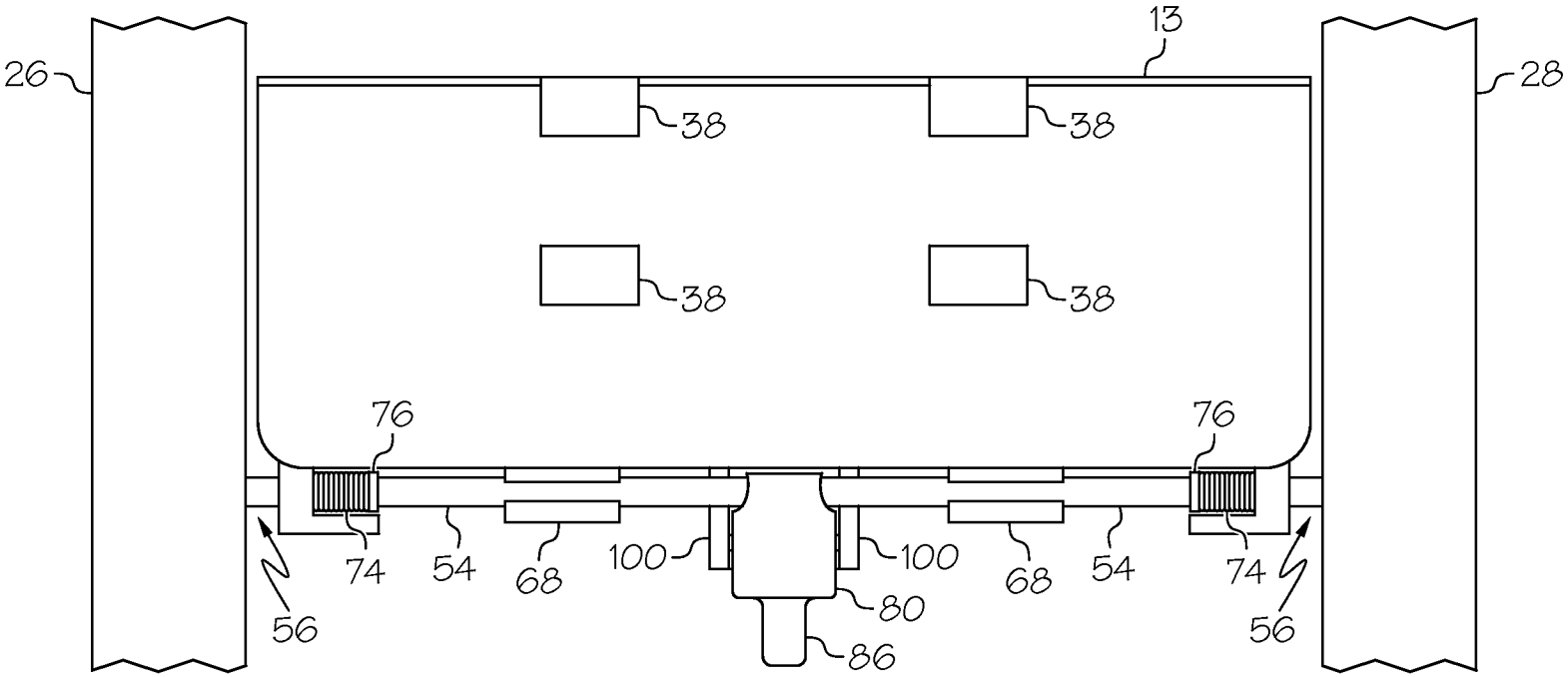
FIG. 9 is a rear view of the bin of FIG. 2 showing the pin in the engaged position and engaged with a wall of a door.

FIG. 9 shows the rear of the bin 13 in relation to the wall 26, 28 of the door 14. The actuator 80 is in the first position corresponding to the engaged position of the pin 54 as shown in FIG. 5. As described above, when in the engaged position, the pin 54 is placed in contact with a portion of the interior of the refrigerator 10 in order to selectively lock the bin 13 at a desired height. In one example, the first end 56 of the pin 54 can contact one, the other, or both of the right wall 26 and the left wall 28 of the door 14.

Figure 10:
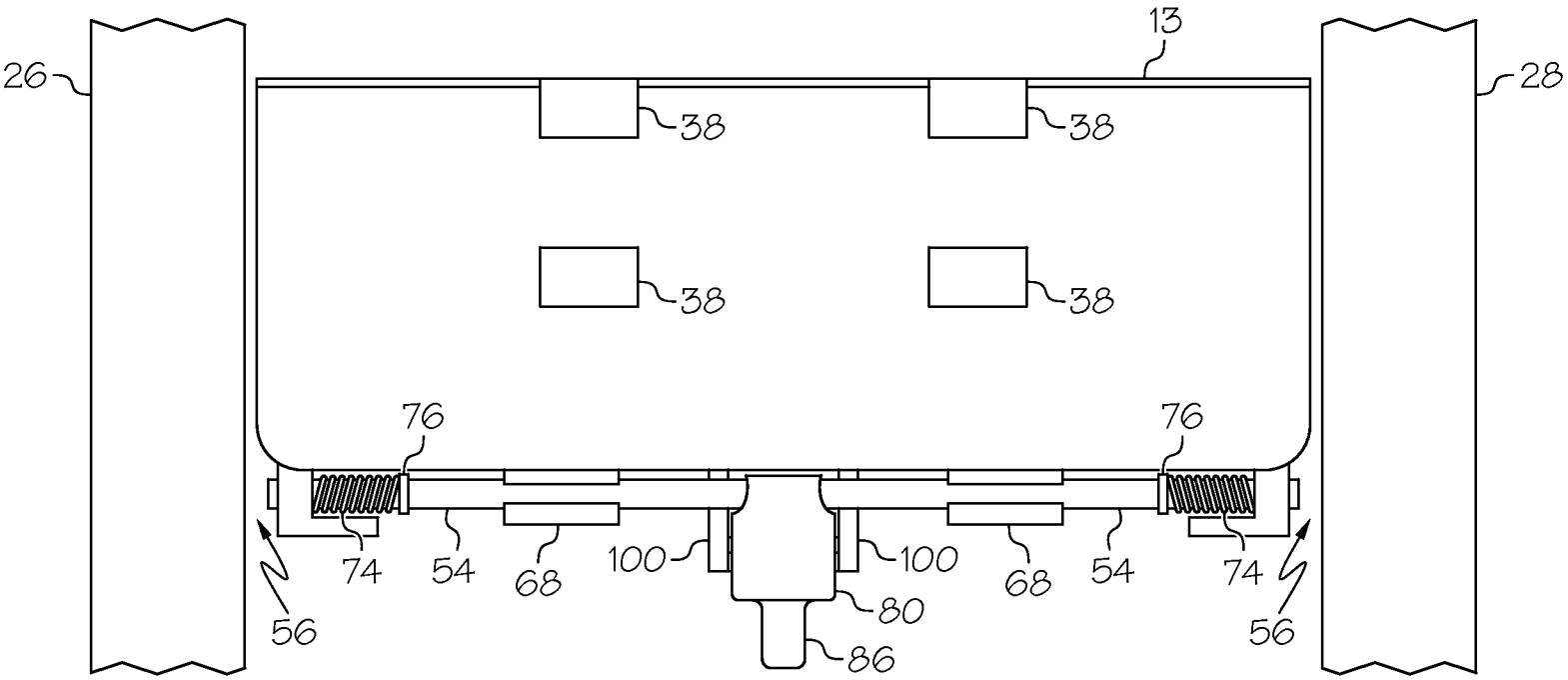
FIG. 10 is similar to FIG. 9 showing the pin in the release position and spaced away from the wall of the door.

FIG. 10 also shows the rear of the bin 13 in relation to the wall 26, 28 of the door 14. Here, the actuator 80 is in the second position corresponding to the release position of the pin 54 as shown in FIG. 8. As described above, when in the release position, the pin 54 is removed from contact with a portion of the interior of the refrigerator 10 in order to enable movement of the bin 13. As shown, the first end 56 of the pin 54 is located a distance away from one, the other, or both of the right wall 26 and the left wall 28 of the door 14.

In the described arrangement, the pin 54 is slidingly engaged with the bin 13. The actuator 80 is selectively rotatable between a first position and a second position. The interaction between the actuator 80 and the pin 54 is such that the pin 54 is selectively movable between an engaged position and a release position. The pin 54 is configured to interact with the actuator 80 such that the actuator 80, when located in the first position, enables the pin 54 to be in the engaged position, and wherein the actuator 80 located in the second position urges the pin 54 to be in the release position. In this particular example, the interaction between the actuator 80 and the pin 54 converts rotational motion of the actuator 80 about the axis 98 into translational motion of the pin 54 in the lateral direction which can be substantially parallel to the axis 98.

As previously described, two sides of the central portion 84 can include a sloping surface such as surface 90. Each of the surfaces 90 can interact with an individual pin 54, when the bin 13 includes at least two pins 54 as shown in FIGS. 5 and 8. In one example, surfaces 90 interact with the pins 54 which can be substantially collinear and the pins 54 operate in substantially opposite directions. While operating in opposite directions, the pins 54 can each engage an individual wall 26, 28 or other structure such as a rail located on one of the doors 14, 18. It is to be appreciated that pins 54 operating in opposite directions can help to effectively make the pins 54 and the attached bin 13 wider than the available space within the door 14, 18 or the compartment 16, 20, thereby "wedging" the bin 13 into place. This action can help to lock the bin 13 into a selected location along the continuum of locations along the track 30.

The described bin and refrigeration appliance include several advantages. The bin can be moved to any location along a continuum of locations on a track within a door or within a compartment of a refrigerator or freezer rather than rely upon discrete locations that are limited by the number and location of mounting devices on a door or in a compartment. As such, the user is able to select from a virtually limitless arrangement of the bins rather than being limited by individual bin mounting structures included in the doors or in the compartments that would otherwise fix the bin in discrete locations. Additionally, the described structure enables a user to move the bin with one hand without fully disconnecting the bin from the refrigeration appliance door. In one example, if a user is holding a relatively tall object that is to be stored in a bin on the door of the refrigeration appliance, vertical spacing between bins may not enable the user to locate the relatively tall object in a particular bin. In this case, the user can keep the relatively tall object in one hand (a first hand) while operating the actuator with the opposite hand. As the opposite hand is operating the handle of the actuator, the user can grip the handle and pull the bin downward to a suitable location, if any additional force is needed to move the bin. The user can then move the actuator back to its first position, moving the pins to the engaged position thereby locking the bin in place. The user can then place the relatively tall object into the bin with his first hand.

Similarly, if the user chooses to move a bin in an upward direction in order to make room to place a relatively tall object in the next lower bin, the user can follow the same steps with one hand and push the desired bin upward. For example, when the user has moved the actuator to its second position, thereby moving the pins to the retracted position, the user can urge the bin upward by pressing a portion of his hand against the bottom of the platform located on the bin. Any portion of the user's hand can come into contact with the bin, such as a substantially planar part of the hand including the index finger, the thumb, and the area between the index finger and the thumb as when the user is making a first and holding the handle within his closed fist.

Another advantage of the described bin and refrigeration appliance is an enhanced enablement of persons having a disability such as a lack of one hand to maneuver the bins within the refrigeration appliance. As the bins can be moved with only one hand, persons having a relatively weak hand or a lack of one hand to still be able to reliably move the bins to suitable locations as desired. An additional advantage of the described bin and refrigeration appliance is the possible location of bins along a continuum of locations with relatively low additional cost to the manufacturing and assembly process.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A refrigeration appliance comprising:

a compartment within the refrigeration appliance for storing food items in a refrigerated environment;

a refrigeration system for providing a cooling effect to the compartment;

a door attached to the refrigeration appliance, wherein the door comprises a storage system and a track, wherein the storage system comprises:

a bin;

a tab attached to the bin, wherein the tab is configured to couple the bin to the track and guide the bin along a continuum of positions on the track;

an actuator attached to the bin, wherein the actuator is selectively movable between a first position and a second position;

a pin slidingly engaged with the bin; and a biasing member biasing the pin toward a released position against the actuator;

wherein the actuator contacts the pin and holds the pin in an engaged position when the actuator is in the first position, and, wherein the bin is movable into a plurality of positions relative to the track and the pin in the engaged position is configured to prevent movement of the bin at any point within the continuum of positions on the track and the bin is movable into a plurality of positions relative to the track when the pin is in the released position.

2. The refrigeration appliance according to claim 1, wherein the pin is configured to be selectively movable between the engaged position and the release position, wherein the actuator holds the pin in the engaged position when the actuator is in the first position, and wherein the actuator enables the pin to be in the release position when the actuator is in the second position.

3. The refrigeration appliance according to claim 1, wherein the pin is configured to interact with a structure not attached to the bin when the pin is in the engaged position.

4. The refrigeration appliance according to claim 1, wherein the biasing member is a spring.

5. The refrigeration appliance according to claim 1, wherein the actuator is rotatably mounted to the bin.

6. The refrigeration appliance according to claim 1, wherein interaction between the actuator and the pin converts rotational motion of the actuator into translational motion of the pin.

7. The refrigeration appliance according to claim 1, wherein the bin includes at least two pins.

8. The refrigeration appliance according to claim 7, wherein the pins are substantially collinear and operate in substantially opposite directions.

9. The refrigeration appliance according to claim 1, wherein the door comprises two side walls, a rear wall connecting the two side walls, and the track is provided on the rear wall.

10. The refrigeration appliance according to claim 9, wherein the pin comprises one end extending away from the bin, and when the pin is in the engaged position, the end of the pin is pressed directly against one of the two side walls of the door.

11. A storage system for storing food items in a temperature-controlled environment, the storage system comprising:

a bin;

a tab attached to the bin, wherein the tab is configured to couple the bin to a track and guide the bin along a continuum of positions on the track;

an actuator attached to the bin, wherein the actuator is selectively movable between a first position and a second position;

a pin slidingly engaged with the bin; and a biasing member biasing the pin toward a released position against the actuator;

wherein the actuator contacts the pin and holds the pin in an engaged position when the actuator is in the first position, and, wherein the bin is movable into a plurality of positions relative to the track and the pin in the engaged position is configured to prevent movement of the bin at any point within the continuum of positions on the track and the bin is movable into a plurality of positions relative to the track when the pin is in the release position.

12. The storage system according to claim 11, wherein the pin is configured to be selectively movable between the engaged position and a release position, wherein the actuator holds the pin in the engaged position when the actuator is in the first position, and wherein the actuator enables the pin to be in the release position when the actuator is in the second position.

13. The storage system according to claim 11, wherein the pin is configured to interact with a structure not attached to the bin when the pin is in the engaged position.

14. The storage system according to claim 11, wherein the actuator is rotatably mounted to the bin.

15. The storage system according to claim 11, wherein interaction between the actuator and the pin converts rotational motion of the actuator into translational motion of the pin.

16. The storage system according to claim 11, wherein the bin includes at least two pins.

17. The storage system according to claim 16, wherein the pins are substantially collinear and operate in substantially opposite directions.

18. A storage system for storing food items in a temperature-controlled environment, the storage system comprising:

a bin;

a tab attached to the bin, wherein the tab is configured to couple the bin to a track and guide the bin along a continuum of positions on the track;

an actuator attached to the bin, wherein the actuator is selectively movable between a first position and a second position; and a pin slidingly engaged with the bin;

wherein the actuator contacts the pin and holds the pin in an engaged position when the actuator is in the first position;

wherein the bin is movable into a plurality of positions relative to the track and the pin in the engaged position is configured to prevent movement of the bin at any point within the continuum of positions on the track;

wherein the pin is configured to be selectively movable between the engaged position and a release position, wherein the actuator holds the pin in the engaged position when the actuator is in the first position, and wherein the actuator enables the pin to be in the release position when the actuator is in the second position; and wherein the actuator has a central portion with a variable width, wherein the central portion of the actuator contacts the pin and holds the pin in the engaged position when the actuator is in the first position.

19. The storage system according to claim 18, wherein when the actuator is in the first position, the central portion is wider than when the actuator is in the second position.

20. A refrigeration appliance comprising:

a compartment within the refrigeration appliance for storing food items in a refrigerated environment;

a refrigeration system for providing a cooling effect to the compartment;

a door attached to the refrigeration appliance, wherein the door comprises a storage system and a track, wherein the storage system comprises:

a bin;

a tab attached to the bin, wherein the tab is configured to couple the bin to the track and guide the bin along a continuum of positions on the track;

an actuator attached to the bin, wherein the actuator is selectively movable between a first position and a second position; and a pin slidingly engaged with the bin, wherein the actuator contacts the pin and holds the pin in an engaged position when the actuator is in the first position, wherein the bin is movable into a plurality of positions relative to the track and the pin in the engaged position is configured to prevent movement of the bin at any point within the continuum of positions on the track, wherein the pin is configured to be selectively movable between the engaged position and a release position, wherein the actuator holds the pin in the engaged position when the actuator is in the first position, and wherein the actuator enables the pin to be in the release position when the actuator is in the second position, and, wherein the actuator has a central portion with a variable width, and when the actuator is in the first position, the central portion is wider than when the actuator is in the second position.

* * * * *